US007374848B2

(12) United States Patent
Matsuoka et al.

(10) Patent No.: US 7,374,848 B2
(45) Date of Patent: May 20, 2008

(54) TONER AND METHOD OR PREPARING THE TONER

(75) Inventors: Sonoh Matsuoka, Numazu (JP); Ryohta Inoue, Numazu (JP); Masahiro Ohki, Numazu (JP); Takeshi Takada, Numazu (JP); Chiaki Tanaka, Tagata-gun (JP); Naohiro Watanabe, Suntou-gun (JP); Masahide Yamada, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 554 days.

(21) Appl. No.: 10/872,640

(22) Filed: Jun. 22, 2004

(65) Prior Publication Data

US 2004/0265721 A1 Dec. 30, 2004

(30) Foreign Application Priority Data

Jun. 24, 2003 (JP) ..... 2003-179554

(51) Int. Cl.
*G03G 9/087* (2006.01)

(52) U.S. Cl. ..... 430/109.4; 430/110.3; 430/110.4; 430/137.1; 430/137.19

(58) Field of Classification Search ..... 430/108.4, 430/109.4, 110.3, 110.4, 137.1, 137.16, 137.17, 430/137.19

See application file for complete search history.

(56) References Cited

U.S. PATENT DOCUMENTS

| | | | | |
|---|---|---|---|---|
| 5,147,747 | A * | 9/1992 | Wilson et al. | 430/108.2 |
| 5,344,985 | A | 9/1994 | Tanaka et al. | 564/426 |
| 5,420,332 | A | 5/1995 | Shimada et al. | 558/269 |
| 5,434,028 | A | 7/1995 | Shimada et al. | 558/269 |
| 5,457,232 | A | 10/1995 | Tanaka et al. | 564/426 |
| 5,459,275 | A | 10/1995 | Tanaka et al. | 548/145 |
| 5,480,753 | A | 1/1996 | Shimada et al. | 430/83 |
| 5,547,792 | A | 8/1996 | Shimada et al. | 430/73 |
| 5,576,132 | A | 11/1996 | Tanaka et al. | 430/71 |
| 5,587,516 | A | 12/1996 | Tanaka et al. | 564/405 |
| 5,599,995 | A | 2/1997 | Tanaka et al. | 564/426 |
| 5,616,805 | A | 4/1997 | Tanaka et al. | 564/405 |
| 5,641,598 | A | 6/1997 | Tanaka et al. | 430/56 |
| 5,663,407 | A | 9/1997 | Shimada et al. | 558/270 |
| 5,672,728 | A | 9/1997 | Tanaka et al. | 558/376 |
| 5,723,243 | A | 3/1998 | Sasaki et al. | 430/96 |
| 5,789,128 | A | 8/1998 | Adachi et al. | 430/83 |
| 5,808,155 | A | 9/1998 | Shimada et al. | 564/355 |
| 5,840,454 | A | 11/1998 | Nagai et al. | 430/96 |
| 5,846,680 | A | 12/1998 | Adachi et al. | 430/73 |
| 5,910,561 | A | 6/1999 | Adachi et al. | 528/196 |
| 5,942,363 | A | 8/1999 | Tanaka et al. | 430/75 |
| 5,976,746 | A | 11/1999 | Tanaka et al. | 430/73 |
| 5,981,124 | A | 11/1999 | Shimada et al. | 430/73 |
| 6,018,014 | A | 1/2000 | Nagai et al. | 528/196 |
| 6,045,959 | A | 4/2000 | Katayama et al. | 430/83 |
| 6,066,428 | A | 5/2000 | Katayama et al. | 430/73 |
| 6,066,757 | A | 5/2000 | Tanaka et al. | 560/138 |
| 6,069,224 | A | 5/2000 | Adachi et al. | 528/198 |
| 6,103,435 | A | 8/2000 | Shimada et al. | 430/56 |
| 6,130,310 | A | 10/2000 | Katayama et al. | 528/196 |
| 6,172,176 | B1 | 1/2001 | Tanaka et al. | 528/196 |
| 6,184,362 | B1 | 2/2001 | Shimada et al. | 534/658 |
| 6,187,494 | B1 | 2/2001 | Kawamura et al. | 430/96 |
| 6,191,249 | B1 | 2/2001 | Tanaka et al. | 528/196 |
| 6,194,535 | B1 | 2/2001 | Katayama et al. | 528/196 |
| 6,271,356 | B1 | 8/2001 | Shimada et al. | 534/755 |
| 6,303,736 | B1 | 10/2001 | Kawamura et al. | 528/196 |
| 6,313,288 | B1 | 11/2001 | Shimada et al. | 540/140 |
| 6,492,079 | B2 | 12/2002 | Shimada et al. | 430/58.05 |
| 6,524,761 | B2 | 2/2003 | Shimada et al. | 430/58 |
| 6,544,701 | B2 | 4/2003 | Tadokoro et al. | 430/58.25 |
| 6,548,216 | B2 | 4/2003 | Kawamura et al. | 430/59.6 |
| 6,582,869 | B2 * | 6/2003 | Daimon et al. | 430/109.4 |
| 6,596,449 | B2 | 7/2003 | Shimada et al. | 430/58.05 |
| 6,645,648 | B2 | 11/2003 | Doushita | 428/694 |
| 6,660,443 | B2 * | 12/2003 | Sugiyama et al. | 430/108.4 |

(Continued)

FOREIGN PATENT DOCUMENTS

JP 03-188468 8/1991

(Continued)

OTHER PUBLICATIONS

U.S. Appl. No. 10/670,320, filed Sep. 26, 2003, Watanabe, et al., originally filed claims, abstract, and drawings only.

(Continued)

*Primary Examiner*—Janis L. Dote
(74) *Attorney, Agent, or Firm*—Oblon, Spivak, McClelland, Maier & Neustadt, P.C.

(57) ABSTRACT

A toner including a binder; a colorant; and a wax, wherein the binder includes a polyester resin; and a reaction product of a polymer having a group capable of reacting with an active hydrogen with a compound having an active hydrogen, wherein the polyester resin includes tetrahydrofuran (THF)-soluble resin components in an amount of from 50 to 85% by weight; and chloroform-insoluble components in an amount of from 0 to 30% by weight, and wherein the toner satisfies the following relationship (1):

$$5\% \text{ by weight} < (C1-C2) < 60\% \text{ by weight} \quad (1)$$

wherein C1 represents a content of chloroform-insoluble components in the toner in units of % by weight and C2 represents a content of the colorant therein in units of % by weight.

10 Claims, No Drawings

U.S. PATENT DOCUMENTS

| | | | | |
|---|---|---|---|---|
| 6,821,698 | B2 * | 11/2004 | Sawada et al. | 430/108.4 |
| 6,998,212 | B2 * | 2/2006 | Shirai et al. | 430/109.3 |
| 2005/0042534 | A1 * | 2/2005 | Tanaka et al. | 430/108.4 |

FOREIGN PATENT DOCUMENTS

| | | |
|---|---|---|
| JP | 07-295290 | 11/1995 |
| JP | 08-234480 | 9/1996 |
| JP | 09-034163 | 2/1997 |
| JP | 2000-056511 | 2/2000 |
| JP | 2000-089514 | 3/2000 |
| JP | 2001-356527 | 12/2001 |
| JP | 2002-082484 | 3/2002 |
| JP | 2002-162773 | 6/2002 |
| JP | 2002-287400 | 10/2002 |
| JP | 2002-351143 | 12/2002 |

OTHER PUBLICATIONS

U.S. Appl. No. 10/647,346, filed Aug. 26, 2003, Suzuki, et al., originally filed claims, abstract, and drawings only.
U.S. Appl. No. 10/674,358, filed Oct. 1, 2003, Sugiyama, et al., originally filed claims, abstract, and drawings only.
U.S. Appl. No. 10/645,804, filed Aug. 22, 2003, Nanya, et al., originally filed claims, abstract, and drawings only.
U.S. Appl. No. 10/458,626, filed Jun. 11, 2003, Nagai, et al., originally filed claims, abstract, and drawings only.
U.S. Appl. No. 10/394,265, filed Mar. 24, 2003, Nanya, et al., originally filed abstract and claims only.
U.S. Appl. No. 10/286,791, filed Nov. 4, 2002, Yamashita, et al., originally filed abstract and claims only.
U.S. Appl. No. 10/247,639, filed Sep. 20, 2002, Sugiyama, et al., originally filed abstract and claims only.
U.S. Appl. No. 10/246,601, filed Sep. 19, 2002, Emoto, et al., originally filed abstract, claims and drawings only.
U.S. Appl. No. 10/284,177, filed Oct. 31, 2002, Tomita, et al., originally filed abstract claims and drawings only.
U.S. Appl. No. 10/286,816, filed Nov. 4, 2002, Sugiyama, et al., originally filed abstract, claims and drawings only.
U.S. Appl. No. 10/188,753, filed Jul. 5, 2002, Sugiyama, et al., originally filed abstract, claims and drawings only.
U.S. Appl. No. 10/092,920, filed Mar. 8, 2002, Yamashita, et al., originally filed abstract, claims and drawings only.
U.S. Appl. No. 10/026,743, filed Dec. 27. 2001, Yano, et al., originally filed abstract, claims and drawings only.
U.S. Appl. No. 10/364,514, filed Feb. 12, 2003, Kawaura, et al., originally filed abstract, claims and drawings only.
U.S. Appl. No. 08/823,694, filed Mar. 25, 1997, Sasaki, et al., originally filed claims only.
U.S. Appl. No. 08/077,444, filed Jun. 17, 1993, Adachi, et al., originally filed claims, abstract and drawings only.
U.S. Appl. No. 11/006,643, filed Dec. 8, 2004, Takada, et al.
U.S. Appl. No. 11/484,565, filed Jul. 12, 2006, Tanaka, et al.
U.S. Appl. No. 11/513,175, filed Aug. 31, 2006, Ohki, et al.
U.S. Appl. No. 11/519,893, filed Sep. 13, 2006, Inoue, et al.
U.S. Appl. No. 11/561,983, filed Nov. 21, 2006, Sugino, et al.
U.S. Appl. No. 11/685,872, filed Mar. 14, 2007, Uchinokura, et al.
U.S. Appl. No. 11/687,075, filed Mar. 16, 2007, Yamada, et al.
U.S. Appl. No. 11/687,372, filed Mar. 16, 2007, Yamada, et al.
U.S. Appl. No. 11/695,750, filed Apr. 3, 2007, Takada, et al.
U.S. Appl. No. 11/685,969, filed Mar. 14, 2007, Uchinokura, et al.
U.S. Appl. No. 11/734,895, filed Apr. 13, 2007, Yamashita, et al.
U.S. Appl. No. 11/868,618, filed Oct. 8, 2007, Sugiyama, et al.
U.S. Appl. No. 11/852,778, filed Sep. 10, 2007, Nagatomo, et al.
U.S. Appl. No. 11/855,806, filed Sep. 14, 2007, Awamura, et al.
U.S. Appl. No. 11/856,379, filed Sep. 17, 2007, Sawada, et al.
U.S. Appl. No. 11/857,791, filed Sep. 19, 2007, Kojima, et al.

* cited by examiner

TONER AND METHOD OR PREPARING THE TONER

BACKGROUND OF THE INVENTION

1. Field of the Invention

The present invention relates to a toner for developing an electrostatic latent image formed on a surface of a photoreceptor to visualize the image in electrophotography and electrostatic recording, and to a method of preparing the toner.

2. Discussion of the Background

Methods of using a heat roller are widely and conventionally used for fixing methods in electrophotography because of their good energy efficiency. When the methods of using a heat roller is used, recently in particular, a toner is required to have a low-temperature fixability to save energy. Particularly, a toner used in high-speed copiers is more required to have the low-temperature fixability, and trials to reduce heat energy applied to a toner when fixed are frequently made. In addition, a standby (warm-up or recovery) period from a time when an image forming apparatus is turned on to a time when an image can be formed is strongly required to become short to reduce electricity consumption as much as possible.

A technology procurement project of copiers for the next generation is present in DSM (Demand-side-Management) programs of International Energy Agency (IEA) in 1999, wherein copiers producing 30 cpm or more are required to have the standby period not greater than 10 sec and electricity consumption of from 10 to 30 W (dependent on copy speed), which will infinitely save more energy than conventional copiers. As one of the methods to achieve this requirement, a method of having fixing members such as heat rollers have low heat capacity and improving a response of a toner to a temperature can be considered, but the method is not satisfactory.

To shorten the standby period as much as possible, lowering a fixing temperature of a toner is considered to be technically essential. In compliance with the requirement, it is considered that a preset temperature of an image forming apparatus using a conventional low-temperature fixable toner needs to be further decreased by 20° C. Therefore, it is impossible to comply with the requirement with ease even if any known technologies are used, and further advanced technologies are essential.

When a toner has a lower temperature fixability, it is supposed to be difficult to establish a range of fixing temperature (hot offset resistance) and maintain thermostable preservability.

Recently, demands for high-quality images increase in the market, and a toner is required to have a smaller particle diameter because a conventional toner having a volume-average particle diameter of from 10 to 15 μm does not produce sufficient high-quality images. However, a toner having a smaller particle diameter causes various problems such as reduction of a toner amount adhered to a halftone image part of a receiving material such as papers and offset phenomena because a heat quantity from a heating member, which is applied to the toner transferred onto a concavity of the receiving material, is extremely reduced.

To prevent the offset, a release agent such as a wax is typically included in a toner and exuded when fixed, and the release agent needs to be present as a domain so as to easily exude. However, depending on presence status of the domain, the wax present on a surface of the toner particle increases, resulting in deterioration of preservability and developability of the resultant toner. Particularly in a fixer having a low surface pressure, the release agent becomes difficult to exude, and it is quite difficult to complete presence status of the release agent domain in consideration of the fixer having a low surface pressure.

As examples of conventional technologies for a toner having both low-temperature fixability and offset resistance, which prevents adverse effects of a wax included therein, Japanese Laid-Open Patent Publications Nos. 7-295290, 8-234480 and 9-34163 disclose a toner having lower-temperature fixability than conventional toners because of its viscoelasticity. However, the low-temperature fixability is still insufficient.

A toner disclosed in Japanese Patent No. 2904520 and Japanese Laid-Open Patent Publication No. 2000-56511 can be fixed at a low pressure and a low temperature. However, the low-temperature fixability is still insufficient in a fixer having a short standby time.

Recently, Japanese Laid-Open Patent Publications Nos. 2000-89514, 2001-356527, 2002-82484, 2002-162773, 2002-287400 and 2003-351143 disclose a toner having a satisfactory low-temperature fixability and high-temperature offset resistance, wherein THF or chloroform insoluble components in a polyester resin mainly used as a binder resin are specified. However, a binder resin having a high low-temperature fixability although almost insoluble with an organic solvent depending thereon, such as crystalline polyester, is available. Insoluble components with one organic solvent are unable to specify a toner having both low-temperature fixability and high-temperature offset resistance recently required because of having different solubility depending on organic solvents.

Because of these reasons, a need exists for a toner having more low-temperature fixability, high-temperature offset resistance, thermostable preservability and colorant dispersibility than ever; applicable in a fixer saving more energy than ever; and having good developability and producing high-quality images for long periods.

SUMMARY OF THE INVENTION

Accordingly, an object of the present invention is to provide a toner having more low-temperature fixability, high-temperature offset resistance, thermostable preservability and colorant dispersibility than ever; applicable in a fixer saving more energy than ever; and having good developability and producing high-quality images for long periods.

Briefly this object and other objects of the present invention as hereinafter will become more readily apparent can be attained by a toner including at least a binder; a colorant; and a wax, wherein the binder includes at least a polyester resin; and a reaction product of a polymer having a group capable of reacting with an active hydrogen with a compound having an active hydrogen, wherein the polyester resin includes tetrahydrofuran(THF)-soluble resin components in an amount of from 50 to 85% by weight; and chloroform-insoluble components in an amount of from 0 to 30% by weight, and wherein the toner satisfies the following relationship (1):

$$5\% \text{ by weight} < (C1-C2) < 60\% \text{ by weight} \quad (1)$$

wherein C1 represents a content of chloroform-insoluble components in the toner in units of % by weight and C2 represents a content of the colorant therein in units of % by weight.

In addition, the THF-soluble components preferably have a weight-average molecular weight of from 1,000 to 30,000.

Further, the polyester resin is preferably an amorphous polyester resin or a mixture of an amorphous polyester resin and a crystalline polyester resin.

These and other objects, features and advantages of the present invention will become apparent upon consideration of the following description of the preferred embodiments of the present invention.

DETAILED DESCRIPTION OF THE INVENTION

Generally, the present invention provides a toner having more low-temperature fixability, high-temperature offset resistance, thermostable preservability and colorant dispersibility than ever; applicable in a fixer saving more energy than ever; and having good developability and producing high-quality images for long periods.

The present inventors discovered that a binder including at least a polyester resin and a polymer having a group capable of reacting with a compound having an active hydrogen (hereinafter referred to as a prepolymer) effectively improves low-temperature fixability of the resultant toner. However, conventional evaluations with THF-soluble and chloroform-soluble components in the binder have not obtained satisfactory results.

The present inventors also discovered that the THF-soluble components are low-molecular-weight and amorphous components, and are required for the low-temperature fixability and particularly indispensable for dispersibility of a colorant. The present inventors further discovered that the chloroform can dissolve crystalline components of a polyester resin and a crystalline polyester resin although the THF cannot.

To seek for a polyester resin capable of maintaining improved low-temperature fixability, high-temperature offset resistance and colorant dispersibility, the present inventors properly controlled THF and chloroform-soluble components by changing a reaction temperature, a reaction time, a decompression degree and a dosage of a monomer having 3 or more valences when producing the polyester resin. As a result of this trial, the present inventors discovered that the polyester resin includes THF-soluble components of from 50 to 85% by weight and chloroform-insoluble components not greater than 30% by weight. Namely, when the THF-soluble components are less than 50% by weight, the colorant dispersibility noticeably deteriorates. When greater than 85% by weight, the improved low-temperature fixability cannot be maintained. Further, the chloroform-insoluble components are greater than 30% by weight, fixability of the resultant toner noticeably deteriorates and satisfactory low-temperature fixability cannot be obtained.

To maintain the high-temperature offset resistance only with a polyester resin, a carboxylic acid or alcohol having three or more functions is used and a crosslinked structure needs to be introduced in the polyester resin. The crosslinked structure is easily cut by a shear force in a kneading process of a pulverized toner, but not in a polymerized toner. Therefore, not only a design of the polyester resin needs to be changed for every kneader and production method, but also production stability of the polyester resin has a problem and production thereof is quite difficult to be industrialized.

In the present invention, a polyester resin is modified using a prepolymer to form a binder having high-temperature offset resistance regardless of a kneader and a method producing the binder. The offset resistance as well as the low-temperature fixability can be evaluated by chloroform-insoluble components of a toner except a colorant, which do not affect the low-temperature fixability thereof. Namely, when the chloroform-insoluble components of a toner except a colorant is less than 5% by weight, elastic modified products of the polyester resin are short and the resultant toner does not have the high-temperature offset resistance. When greater than 60% by weight, low-molecular-weight and crystalline components are short and the resultant toner does not have the low-temperature fixability.

The present inventors discovered that a toner has satisfactory low-temperature fixability, high-temperature offset resistance and colorant dispersibility when a polyester resin as a binder in the toner includes THF-soluble resin components in an amount of from 50 to 85% by weight and chloroform-insoluble components in an amount of from 0 to 30% by weight, and the toner satisfies the following relationship (1):

$$5\% \text{ by weight} < (C1-C2) < 60\% \text{ by weight} \quad (1)$$

wherein C1 represents a content of chloroform-insoluble components in the toner in units of % by weight and C2 represents a content of the colorant therein in units of % by weight.

In the present invention, THF-soluble components are measured by the following method.

50 g of THF is added to 1.0 g of a sample to prepare a solution, and the solution is left for a day at 25° C. First, the solution is centrifuged and filtered by a checkweighed quantitative filter paper of 5C in JIS standard P3801 to prepare a filter paper residue, i.e., a THF-insoluble component. Then, the residue is sufficiently dried, and which is calculated by the following formula:

THF-insoluble components=(dried filter paper weight after filtration−filter paper weight before filtration)/sample weight×100 (% by weight)

THF-soluble components=100−THF-insoluble components (% by weight)

In the present invention, chloroform-insoluble components are measured by the following method.

50 g of chloroform is added to 1.0 g of a sample to prepare a solution, and the solution is left for a day at 25° C. First, the solution is centrifuged and filtered by a checkweighed quantitative filter paper of 5C in JIS standard P3801 to prepare a filter paper residue, i.e., a chloroform-insoluble component. Then, the residue is sufficiently dried, and which is calculated by the same method of the above-mentioned THF-insoluble components. Chloroform-insoluble components in a toner are measured by the same method. However, the chloroform-insoluble components are separately measured by a thermal analysis because the filter paper residue includes a colorant.

The present inventors discovered that the THF-soluble components of the polyester resin preferably have a weight-average molecular weight of from 1,000 to 30,000 to prepare a toner maintaining thermostable preservability, effectively exerting low-temperature fixability and having offset resistance. When less than 1,000, the thermostable preservability deteriorates because an oligomer components increase. When greater than 30,000, the offset resistance deteriorates because the polyester resin is not sufficiently modified due to a steric hindrance.

In the present invention, molecular weight is measured by GPC (gel permeation chromatography) as follows. A column is stabilized in a heat chamber having a temperature of 40° C.; THF is put into the column at a speed of 1 ml/min as a solvent; 50 to 200 μl of a THF liquid-solution of a resin, having a sample concentration of from 0.05 to 0.6% by weight, is put into the column; and a molecular weight distribution of the sample is determined by using a calibration curve which is previously prepared using several polystyrene standard samples having a single distribution peak, and which shows the relationship between a count number and the molecular weight. As the standard polystyrene samples for making the calibration curve, for example, the samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $48\times10^6$ from Pressure Chemical Co. or Tosoh Corporation are used. It is preferable to use at least 10 standard polystyrene samples. In addition, an RI (refraction index) detector is used as the detector.

Further, a mixture of an amorphous polyester resin and a crystalline polyester resin is preferably used for a toner having well-balanced low-temperature fixability, high-temperature off set resistance and colorant dispersibility. The amorphous polyester resin is good for the colorant dispersibility, but not for the low-temperature fixability. The crystalline polyester resin is good for the low-temperature fixability, but not for the colorant dispersibility. Therefore, the polyester resin more preferably includes the amorphous polyester resin in an amount of 60 to 99% by weight.

THF-insoluble components in the amorphous polyester are high-molecular-weight elastic bodies called as gels which effectively improve offset resistance of the resultant toner. In the present invention, the gel components are negative factors for the low-temperature fixability because the prepolymer modification imparts offset resistance to the resultant toner. Therefore, the amorphous polyester in the present invention preferably includes the THF-soluble components in an amount of from 70 to 100% by weight in a range which does not impair low-temperature fixability of the resultant toner. Further, THF-soluble components in the amorphous polyester preferably has a weight-average molecular weight of from 1,000 to 50,000. When less than 1,000, the thermostable preservability deteriorates because an oligomer components increase, and when greater than 50,000, the offset resistance deteriorates because the polyester resin is not sufficiently modified due to a steric hindrance.

In addition, the amorphous polyester preferably has an acid value of from 1.0 to 50.0 (Mg KOH/g) to further improve low-temperature fixability, high-temperature offset resistance, thermostable preservability and charge stability of the resultant toner. When greater than 50.0 (Mg KOH/g), an elongation or a cross-linking reaction of a modified polyester is not sufficient and the high-temperature offset resistance of the resultant toner deteriorates. When less than 1.0 (Mg KOH/g), the elongation or a cross-linking reaction of a modified polyester easily exerted and production stability of the resultant toner deteriorates.

In the present invention, the acid value is measured by the method according to JIS K0070. However, when a sample is not dissolved, a solvent such as dioxane and THF is used.

In the present invention, the amorphous polyester preferably has a glass transition temperature of from 35 to 65° C. because thermostable preservability of the modified polyester, i.e., the main component of a binder depends on a glass transition temperature of the polyester before modified. When less than 35° C., the thermostable preservability of the resultant toner is insufficient. When greater than 65° C., low-temperature fixability of the resultant toner deteriorates.

In the present invention, the glass transition temperature is measured by Rigaku THERMOFLEX TG8110® from RIGAKU Corp. at a programming rate of 10° C./min.

In the present invention, the crystalline polyester preferably includes chloroform-soluble components in an amount of from 60 to 100% by weight to further improve low-temperature fixability of the resultant toner. When less than 60% by weight, the crystalline polyester is close to an elastic body and low-temperature fixability of the resultant toner slightly deteriorates. Further, chloroform-soluble components in the crystalline polyester preferably has a weight-average molecular weight of from 1,500 to 25,000 because of the same reason of the above-mentioned amorphous polyester.

Further, the crystalline polyester preferably has an acid value of from 1.0 to 50.0 (Mg KOH/g) to further improve low-temperature fixability, high-temperature offset resistance and thermostable preservability of the resultant toner because of the same reason of the above-mentioned amorphous polyester. In addition, the crystalline polyester preferably has a glass transition temperature of from 50 to 135° C.

In the present invention, the prepolymer modifying the polyester resin is quite an essential binder to realize low-temperature fixability and high-temperature offset resistance of the resultant toner, and preferably has a weight-average molecular weight of from 3,000 to 20,000. When less than 3,000, the reaction speed is difficult to control and the production stability deteriorates. When greater than 20,000, a well-modified polyester cannot be obtained and offset resistance of the resultant toner deteriorates. In addition, to impart high-temperature offset resistance to the resultant toner, it is most essential to impart elasticity to the modified polyester, and therefore the prepolymer preferably has two or more functional groups on average. When less than two or more functional groups on average, the modified polyester does not have sufficient elasticity and the high-temperature offset resistance of the resultant toner deteriorates.

In the present invention, an acid value of a toner is more essential index than that of a binder for low-temperature fixability and high-temperature offset resistance of the resultant toner. An acid value of the toner of the present invention comes from an end carboxyl group of an unmodified polyester resin. The unmodified polyester resin preferably has an acid value of form 0.5 to 40.0 (Mg KOH/g) to control low-temperature fixability such as minimum fixable temperature and hot offset generation temperature of the resultant toner. When greater than 40.0 (mg KOH/g), an elongation or a cross-linking reaction of a modified polyester is not sufficient and the high-temperature offset resistance of the resultant toner deteriorates. When less than 0.5 (mg KOH/g), the elongation or a cross-linking reaction of a modified polyester easily exerted and production stability of the resultant toner deteriorates.

The toner of the present invention preferably has a glass transition temperature of from 40 to 70° C. to have low-temperature fixability, high-temperature offset resistance and high durability. When less than 40° C., toner blocking in an image developer and filming over a photoreceptor tend to occur. When greater than 70° C., low-temperature fixability of the resultant toner deteriorates.

The toner of the present invention preferably has a volume-average particle diameter (Dv) of from 3 to 8 μm, and a ratio (Dv/Dn) to a number-average particle diameter (Dn) is preferably not greater than 1.25. When the ratio (Dv/Dn) is not greater than 1.25, the resultant toner produces high-resolution and high-quality images. It is more preferable that the toner has a volume-average particle diameter (Dv) of from 3 to 7 μm, a ratio (Dv/Dn) to a number-average particle diameter (Dn) is not greater than 1.20, and that the number of toner particles having a particle diameter not greater than 3 μm is from 1 to 10% by number. It is furthermore preferable that the toner has a volume-average particle diameter (Dv) of from 3 to 6 μm, and that a ratio (Dv/Dn) to a number-average particle diameter (Dn) is not greater than 1.15. Such a toner has good thermostable preservability, low-temperature fixability and high-temperature offset resistance, and particularly produces images having good glossiness when used in a full-color copier. Further, when used in a two-component developer, the toner has less variation of its particle diameter in the developer even after the toner is consumed and fed for long periods, and has good and stable developability even after stirred in an image developer for long periods.

The average particle diameter and particle diameter distribution of the toner of the present invention are measured by a COULTER COUNTER TA-II. An Interface producing a number distribution and a volume distribution from Nikkaki Bios Co., Ltd. and a personal computer PC9801 from NEC Corp. are connected with the Coulter MULTISIZER II to measure the average particle diameter and particle diameter distribution.

The toner of the present invention preferably has a specific shape and a shape distribution, and when the toner has an average circularity less than 0.94, the toner has difficulty in having sufficient transferability and producing high quality images without a toner dust. As a method of identifying the shape, an optical detection method of passing a suspension including a particle through a tabular imaging detector and optically detecting and analyzing the particle image with a CCD camera is suitably used. A peripheral length of a circle having a projected area equivalent to that of the image optically detected is divided by an actual peripheral length of the toner particle to determine the circularity of the toner. A toner having an average circularity of from 0.94 to 1.00 produces high definition images having proper image density and reproducibility.

The average circularity of the toner of the present invention is measured by a flow-type particle image analyzer FPIA-2000® from SYSMEX CORPORATION. A specific measuring method includes adding 0.1 to 0.5 ml of a surfactant, preferably an alkylbenzenesulfonic acid, as a dispersant in 100 to 150 ml of water from which impure solid materials are previously removed; adding 0.1 to 0.5 g of the toner in the mixture; dispersing the mixture including the toner with an ultrasonic disperser for 1 to 3 min to prepare a dispersion liquid having a concentration of from 3,000 to 10,000 pieces/μl; and measuring the toner shape and distribution with the above-mentioned measurer.

The toner of the present invention preferably has a BET specific surface area of from 1.0 to 6.0 ($m^2/g$). When less than 1.0 ($m^2/g$), presence of coarse particles and inclusion of additives deteriorate images produced by the toner. When greater than 6.0 ($m^2/g$), presence of microscopic particles, exposure of the additives and surface concavities and convexities of the toner deteriorate images produced thereby.

The BET specific surface area can be measured by NOVA series® from Yuasa Ionics Inc., applicable to JIS standards Z8830 and R1626.

The toner of the present invention can be prepared by a conventional pulverizing method. However, the toner of the present invention is preferably prepared in an environment wherein neither a shear force nor a heat is applied thereto because the toner receiving neither the shear force nor heat stably exerts best performance. Namely, the toner is preferably prepared by dissolving or dispersing at least a polyester resin, a prepolymer, a colorant and a wax to prepare a solution or a dispersion liquid; dispersing the solution or dispersion liquid in an aqueous solvent; removing the organic solvent from the solution or dispersion liquid after or while reacting the prepolymer in the aqueous solvent to prepare a reaction product; and washing and drying the a reaction product.

Further, a method of preparing the toner of the present invention preferably includes a polymerization process of reacting a polyester prepolymer A including an isocyanate group, which is dispersed in an aqueous medium including an inorganic and or a polymer particulate material, with amine B.

Next, materials for use in the toner of the present invention will be explained.

The polyester resin for use in the preset invention is conventionally prepared by a condensation polymerization between an alcohol and a carboxylic acid. Specific examples of the alcohol include glycols such as ethylene glycol, diethylene glycol, triethylene glycol and propylene glycol; esterified bisphenol such as 1,4-bis (hydroxymethyl) cyclohexane and bisphenol A; bivalent alcohol monomers; and polyalcohol monomers having three or more valences. Specific examples of the carboxylic acid include bivalent organic acid monomers such as maleic acids, fumaric acids, phthalic acids, isophthalic acids, terephthalic acids, succinic and malonic acids; and polycarbonate monomers having three or more valences such as 1,2,4-benzenetricarboxylic acids, 1,2,5-benzenetricarboxylic acids, 1,2,4-cyclohexanetricarboxylic acids, 1,2,4-naphthalenetricarboxylic acids, 1,2,5-hexanetricarboxylic acids, 1,3-dicarboxyl-2-methylmethylenecarboxypropane and 1,2,7,8-octantetracarboxylic acids.

A polyester prepolymer having an isocyanate group A is preferably used in the present invention, and can be prepared by reacting a polyester resin having an active hydrogen atom, which is formed by polycondensation between polyol (PO) and a polycarboxylic acid (PC), with polyisocyanate (PIC). Specific examples of the groups including the active hydrogen include a hydroxyl group (an alcoholic hydroxyl group and a phenolic hydroxyl group), an amino group, a carboxyl group, a mercapto group, etc. In particular, the alcoholic hydroxyl group is preferably used.

The polyester can be formed by a polycondensation reaction between a polyol compound and a polycarbonate compound.

As the polyol (PO), diol (DIO) and triol (TO) can be used, and the DIO alone or a mixture of the DIO and a small amount of the TO is preferably used. Specific examples of the DIO include alkylene glycol such as ethylene glycol, 1,2-propylene glycol, 1,3-propylene glycol, 1,4-butanediol, and 1,6-hexanediol; alkylene ether glycol such as diethylene glycol, triethylene glycol, dipropylene glycol, polyethylene glycol, polypropylene glycol and polytetramethylene ether glycol; alicyclic diol such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide. In particular, alkylene glycol having 2 to 12 carbon atoms and adducts of bisphenol with an alkylene oxide are preferably used, and a mixture thereof is more preferably used. Specific examples of the TO include multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide.

As the polycarbonate (PC), dicarboxylic acid (DIC) and tricarboxylic acid (TC) can be used. The DIC alone, or a mixture of the DIC and a small amount of the TC are preferably used. Specific examples of the DIC include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylene dicarboxylic acid having 4 to 20 carbon atoms and aromatic dicarboxylic acid having 8 to 20 carbon atoms are preferably used. Specific examples of the TC include aromatic polycarboxylic acids having 9 to 20 carbon atoms such as trimellitic acid and pyromellitic acid. PC can be formed from a reaction between the PO and the above-mentioned acids anhydride or lower alkyl ester such as methyl ester, ethyl ester and isopropyl ester.

The PO and PC are mixed such that an equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

Specific examples of the PIC include aliphatic polyisocyanate such as tetramethylenediisocyanate, hexamethylenediisocyanate and 2,6-diisocyanatemethylcaproate; alicyclic polyisocyanate such as isophoronediisocyanate and cyclohexylmethanediisocyanate; aromatic diisocyanate such as tolylenedisocyanate and diphenylmethanediisocyanate; aroma aliphatic diisocyanate such as $\alpha,\alpha,\alpha',\alpha'$-tetramethylxylylenediisocyanate; isocyanurate; the above-mentioned polyisocyanate blocked with phenol derivatives, oxime and caprolactam; and their combinations.

When the polyester prepolymer having an isocyanate group, the PIC is mixed with polyester such that an equivalent ratio ([NCO]/[OH]) between an isocyanate group [NCO] and a polyester resin having a hydroxyl group [OH] is typically from 5/1 to 1/1, preferably from 4/1 to 1.2/1 and more preferably from 2.5/1 to 1.5/1. A content of the PIC in the polyester prepolymer A having a polyisocyanate group is from 0.5 to 40% by weight, preferably from 1 to 30% by weight and more preferably from 2 to 20% by weight.

As the amine B, a polyamine and/or amines having a group including an active hydrogen. The group including an active hydrogen includes hydroxyl groups and mercapto groups. Specific examples of the amines (B) include diamines (B1), polyamines (B2) having three or more amino groups, amino alcohols (B3), amino mercaptans (B4), amino acids (B5) and blocked amines (B6) in which the amines (B1 to B5) mentioned above are blocked.

Specific examples of the diamines (B1) include aromatic diamines such as phenylene diamine, diethyltoluene diamine and 4,4'-diaminodiphenyl methane; alicyclic diamines such as 4,4'-diamino-3,3'-dimethyldicyclohexyl methane and diaminocyclohexane and isophorondiamine); aliphatic diamines such as ethylene diamine, tetramethylene diamine and hexamethylene diamine; etc.

Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these amines (B), diamines (B1) and mixtures in which a diamine is mixed with a small amount of a polyamine (B2) are preferably used.

When the prepolymer A is reacted with the amine B, a molecular weight of the polyester can optionally be controlled using an elongation anticatalyst. Specific examples of the elongation anticatalyst include monoamines such as diethyle amine, dibutyl amine, butyl amine and lauryl amine, and blocked amines, i.e., ketimine compounds prepared by blocking the monoamines mentioned above. A dosage of the elongation anticatalyst depends upon a desired molecular weight of the resultant modified polyester.

A mixing ratio (i.e., a ratio [NCO]/[NHx] which is an amino group n the amine B) of the prepolymer A having an isocyanate group to the amine B is from 1/2 to 2/1, preferably from 1.5/1 to 1/1.5 and more preferably from 1.2/1 to 1/1.2.

In the present invention, when the above-mentioned polyester resin and prepolymer are included in a toner as a binder and chloroform-insoluble components of the toner is in the above-mentioned range, resins besides the polyester resin can also be used in combination therewith.

Specific examples of the resins include styrene resins (styrene or styrene polymers and substituted styrene polymers) such as polystyrene, chloropolystyrene poly $\alpha$-methylstyrene, styrene-chlorostyrene copolymers, styrene-propylene copolymers, styrene-butadiene copolymers, styrene-vinylchloride copolymers, styrene-vinylacetate copolymers, styrene-maleate copolymers, styrene-esteracrylate copolymers (styrene-methylacrylate copolymers, styrene-ethylacrylate copolymers, styrene-butylacrylate copolymers, styrene-octylacrylate copolymers, styrene-phenylacrylate copolymers, etc.), styrene-estermethacrylate copolymers (styrene-methylmethacrylate copolymers, styrene-ethylmethacrylate copolymers, styrene-butylmethacrylate copolymers, styrerie-phenylacrylate copolymers, etc.), styrene-$\alpha$-chlormethylacrylate copolymers and styrene-acrylonitrile-esteracrylate copolymers; vinylchloride resins; styrene-vinylacetate resins; rosin-modified maleic acid resins; phenol resins; epoxy resins; polyethylene resins; polypropylene resins; ionomer resins; polyurethane resins; silicone resins; ketone resins; ethylene-ethylacrylate resin; xylene resins; polyvinylbutyral resins; petroleum resins; and petroleum resins including a hydrogen atom.

Methods of preparing these resins are not particularly limited, and any methods such as mass polymerization, solution polymerization, emulsion polymerization and suspension polymerization methods can be used.

Specific examples of the colorants for use in the present invention include any known dyes and pigments such as carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination. A content of the colorant in the toner is preferably from 1 to 15% by weight, and more preferably from 3 to 10% by weight, based on total weight of the toner.

The colorant for use in the present invention can be used as a master batch pigment when combined with a resin. Specific examples of the resin for use in the master batch pigment or for use in combination with master batch pigment include the modified and unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butylmethacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batch for use in the toner of the present invention is typically prepared by mixing and kneading a resin and a colorant upon application of a high shear force thereto. In this case, an organic solvent can be used to heighten the interaction of the colorant with the resin. In addition, flushing methods in which an aqueous paste including a colorant is mixed with a resin solution of an organic solvent to transfer the colorant to the resin solution and then the aqueous liquid and organic solvent are separated and removed can be preferably used because the resultant wet cake of the colorant can be used as it is. Of course, a dry powder which is prepared by drying the wet cake can also be used as a colorant. In this case, a three roll mill is preferably used for kneading the mixture upon application of a high shear force.

The toner of the present invention may include a wax together with a toner binder and a colorant. Specific examples of the wax include known waxes, e.g., polyolefin waxes such as polyethylene wax and polypropylene wax; long chain carbon hydrides such as paraffin wax and sasol wax; and waxes including carbonyl groups. Among these waxes, the waxes including carbonyl groups are preferably used. Specific examples thereof include polyesteralkanate such as carnauba wax, montan wax, trimethylolpropanetribehenate, pentaelislitholtetrabehenate, pentaelislitholdiacetatedibehenate, glycerinetribehenate and 1,18-octadecanedioldistearate; polyalkanolesters such as tristearyltrimellitate and distearylmaleate; polyamidealkanate such as ethylenediaminebehenylamide; polyalkylamide such as tristearylamidetrimellitate; and dialkylketone such as distearylketone. Among these waxes including a carbonyl group, polyesteralkanate is preferably used.

The wax for use in the present invention typically has a melting point of from 40 to 160° C., preferably of from 50 to 120° C., and more preferably of from 60 to 90° C. A wax having a melting point less than 40° C. has an adverse effect on its high temperature preservability, and a wax having a melting point greater than 160° C. tends to cause cold offset of the resultant toner when fixed at a low temperature. In addition, the wax preferably has a melting viscosity of from 5 to 1,000 cps, and more preferably of from 10 to 100 cps when measured at a temperature higher than the melting point by 20° C. A wax having a melting viscosity greater than 1,000 cps makes it difficult to improve hot offset resistance and low-temperature fixability of the resultant toner. A content of the wax in a toner is preferably from 0 to 40% by weight, and more preferably from 3 to 30% by weight.

The toner of the present invention may optionally include a charge controlling agent. Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

A content of the charge controlling agent is determined depending on the species of the binder used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder included in the toner. When the content is too high, the toner has too large charge quantity, and thereby the electrostatic force of a developing roller attracting the toner increases, resulting in deterioration of the fluidity of the toner and decrease of the image density of toner images. These charge controlling agent can be dissolved and dispersed after kneaded upon application of heat together with a master batch pigment and resin, can be added when directly dissolved and dispersed in an organic solvent or can be fixed on a toner surface after the toner particles are produced.

As an external additive for improving fluidity, developability and chargeability of the colored particles of the present invention, inorganic particulates are preferably used. The inorganic particulates preferably have a primary particle diameter of from 2 nm to 2 μm, and more preferably from 20 nm to 500 nm. In addition, a specific surface area of the inorganic particulates measured by a BET method is preferably from 20 to 500 $m^2/g$. The content of the external additive is preferably from 0.01 to 5% by weight, and more preferably from 0.01 to 2.0% by weight, based on total weight of the toner. Specific examples of the inorganic particulates include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, rediron oxide, antimony trioxide, magnesium oxide, zirconium oxide, barium sulfate, barium carbonate, calcium carbonate, silicon carbide, silicon nitride, etc.

Other than these materials, polymer particulates such as polystyrene formed by a soap-free emulsifying polymerization, a suspension polymerization or a dispersing polymerization, estermethacrylate or esteracrylate copolymers, silicone resins, benzoguanamine resins, polycondensation particulates such as nylon and polymer particles of thermosetting resins can be used.

These external additives , i.e., surface treatment agents can increase hydrophobicity and prevent deterioration of fluidity and chargeability of the resultant toner even in high humidity. Specific examples of the surface treatment agents include silane coupling agents, sililating agents, silane coupling agents having an alkyl fluoride group, organic titanate coupling agents, aluminium coupling agents silicone oils and modified silicone oils.

The toner of the present invention may include a cleanability improver for removing a developer remaining on a photoreceptor and a first transfer medium after transferred. Specific examples of the cleanability improver include fatty acid metallic salts such as zinc stearate, calcium stearate and stearic acid; and polymer particles prepared by a soap-free emulsifying polymerization method such as polymethylmethacrylate particles and polystyrene particles. The polymer particles comparatively have a narrow particle diameter distribution and preferably have a volume-average particle diameter of from 0.01 to 1 μm.

Further, the toner of the present invention can be used as a magnetic toner when a magnetic material is included therein. Specific examples of the magnetic materials include iron oxides such as magnetite, hematite and ferrite; metals such as cobalt and nickel; or their metal alloys and mixtures with aluminium, copper, lead, magnesium, tin, zinc, stibium, beryllium, bismuth, cadmium, calcium, manganese, selenium, titanium, tungsten, vanadium, etc. Particularly, the magnetite is preferably used in terms of its magnetic property. The magnetic material preferably has an average particle diameter of from about 1 to 2 μm. The toner preferably include the magnetic material in an amount of from 15 to 200 parts by weight, and preferably from 20 to 100 parts by weight per 100 parts by weight of the resins in the toner.

The toner of the present invention can be used as a two-component developer in combination with a carrier as well as one-component developer. Specific examples of the carrier include known carriers such as powders of iron, ferrite and nickel having magnetism; glass beads; and the powders and glass beads coated with a resin. Specific examples of the resin include styrene-acrylic copolymers, silicone resins, maleic acid resins, fluorocarbon resins, polyester resins, epoxy resins, etc. The styrene-acrylic copolymers preferably include styrene in an amount of form 30 to 90% by weight. When less than 30% by weight, the resultant developer has a low developability. When greater than 90% by weight, a coated film becomes hard and easy to peel, resulting in a short life of the resultant carrier. In addition, a material for coating the carrier may include an adhesion additive, a hardener, a lubricant, an electroconductive material, a charge controlling agent, etc. besides the resin.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation for Polyester

A condensation reaction was performed between 690 parts of an adduct of bisphenol A with 2 moles of ethyleneoxide and 268 parts of terephthalic acid in a reaction vessel including a cooling pipe, a stirrer and a nitrogen inlet pipe at 210° C. for 10 hrs under a normal pressure and nitrogen stream to prepare a reaction product. Further, after the reaction product reacted while dehydrated under a depressure by 10 to 15 mm Hg for another 5 hrs, the reaction product was cooled to prepare a polyester (A). The polyester (A) which was amorphous, included THF-soluble components in an amount of 85% by weight, having a weight-average molecular weight of 6,000; chloroform-insoluble components in an amount of 5% by weight; had an acid value of 10 mg KOH/g; and a glass transition temperature of 48° C.

A condensation reaction was performed among 520 parts of 1,4-butanediol, 600 parts of fumaric acid, 70 parts of trimellitic acid anhydride and 0.3 parts of hydroquinone in a reaction vessel including a cooling pipe, a stirrer and a nitrogen inlet pipe at 175° C. for 6 hrs under a normal pressure and nitrogen stream to prepare a reaction product. Further, after the reaction product reacted while dehydrated under a depressure by 5 to 10 mm Hg for another 1 hr, the reaction product was cooled to prepare a polyester (B). The polyester (B) which was crystalline, included THF-soluble components in an amount of 5% by weight; chloroform-insoluble components in an amount of 0% by weight; chloroform-soluble components having a weight-average molecular weight of 5,500; had an acid value of 8 mg KOH/g; and a glass transition temperature of 85° C.

Preparation for Prepolymer

A condensation reaction was performed among 795 parts of an adduct of bisphenol A with 2 moles of ethyleneoxide, 200 parts of isophthalic acid, 65 parts of terephthalic acid and 2 parts of dibutyltinoxide in a reaction vessel including a cooling pipe, a stirrer and a nitrogen inlet pipe at 210° C. for 8 hrs under a normal pressure and nitrogen stream to prepare a reaction product. Further, after the reaction product reacted while dehydrated under a depressure by 10 to 15 mm Hg for another 5 hrs, the reaction product was cooled to have a temperature of 80° C. and was further reacted with 170 parts of isophoronediisocyanate in ethylacetate for 2 hrs prepare a prepolymer (a). The prepolymer (a) had a weight-average molecular weight of 5,000 and an average number of functional groups of 2.25.

Preparation for Ketimine Compound 30 parts of isophorondiamine and 70 parts of methyl ethyl ketone were reacted at 50° C. for 5 hrs in a reaction vessel including a stirrer and a thermometer to prepare a ketimine compound (1).

Preparation for Toner

After 76 parts of the polyester (A), 4 parts of the polyester (B), 20 parts of the prepolymer (a), 2 parts of the ketimine compound (1), 5 parts of de-free fatty acid type camauba wax, 10 parts of carbon black (#44 from Mitsubishi Chemical Corp.) and 1 part of azo compound including a metal were mixed with a mixer HENSCHEL MIXER to prepare a mixture, the mixture was kneaded upon application of heat with a roll mill at 130 to 140° C. for about 30 min and cooled to have a room temperature to prepare a kneaded mixture. Then, the kneaded mixture was pulverized with a jet mill to prepare a pulverized mixture, and the pulverized mixture was classified with a wind classifier to prepare a mother toner having a volume-average particle diameter of 6.8 μm. 0.5 parts of hydrophobic silica were mixed with the mother toner to prepare a final toner (T1).

Example 2

Preparation for Polyester

A condensation reaction was performed among 690 parts of an adduct of bisphenol A with 2 moles of ethyleneoxide, 270 parts of terephthalic acid and 10 parts of trimellitic acid anhydride in a reaction vessel including a cooling pipe, a stirrer and a nitrogen inlet pipe at 210° C. for 10 hrs under a normal pressure and nitrogen stream to prepare a reaction product. Further, after the reaction product reacted while dehydrated under a depressure by 10 to 15 mm Hg for another 5 hrs, the reaction product was cooled to prepare a polyester (C). The polyester (C) which was amorphous, included THF-soluble components in an amount of 75% by weight, having a weight-average molecular weight of 30,000; chloroform-insoluble components in an amount of 17% by weight; had an acid value of 2 mg KOH/g; and a glass transition temperature of 58° C.

Preparation for Toner 14.3 parts of the prepolymer (a), 52 parts of the polyester (C), 3 parts of the polyester (B) and 78.6 parts of ethylacetate were stirred and dissolved in a beaker to prepare a solution. On the other hand, 10 parts of rice wax which is a release agent, 4 parts of copper phthalocyanine blue pigment and 100 parts of ethylacetate were dispersed in a beads mill for 30 min to prepare another solution. After the two solutions were mixed and stirred with a TK-type homomixer at 12,000 rpm for 5 min to prepare a mixed solution, the mixed solution was dispersed with a beads mill for 10 min to prepare a oil dispersion of toner materials (1). While 306 parts of ion-exchanged water, 265 parts of a suspension including 10% of tricalcium phosphate and 0.2 parts of sodium dodecylbenzenesulfonate were stirred in a beaker with a TK-type homomixer at 12,000 rpm to prepare a water dispersion (1), the oil dispersion of toner materials (1) and 2.7 parts of the ketimine compound (1) were added to the water dispersion (1), and which was further stirred for another 30 min to prepare a dispersion liquid having a viscosity of 3,500 mP·s. After an organic solvent was removed from the dispersion liquid under depressure within 1.0 hr at 50° C. or less, the dispersion liquid was filtered to prepare a filtered material. Then, the filtered material was washed, dried and classified with a wind classifier to prepare a spheric mother toner. 100 parts of the mother toner and 0.25 parts of a charge controlling agent (Bontron E-84 from Orient Chemical Industries Co., Ltd.) were mixed with a Q-type mixer (from Mitsui Mining Co., Ltd.) at a peripheral speed (of its turbine-formed blade) of 50 m/sec to prepare a mixture. The mixing operation included 5 cycles of mixing for 2 min and pausing for 1 min. Further, 0.5 parts of hydrophobic silica (H2000 from Clariant Japan KK) were mixed with the mixture, which included 5 cycles of mixing for 30 sec at a peripheral speed of 15 m/sec and pausing for 1 min, to prepare a final toner (T2).

Example 3

Preparation for Polyester

A condensation reaction was performed between 670 parts of an adduct of bisphenol A with 2 moles of ethyleneoxide and 300 parts of terephthalic acid in a reaction vessel including a cooling pipe, a stirrer and a nitrogen inlet pipe at 210° C. for 10 hrs under a normal pressure and nitrogen stream to prepare a reaction product. Further, after the reaction product reacted while dehydrated under a depressure by 10 to 15 mm Hg for another 3 hrs, the reaction product was cooled to prepare a polyester (D). The polyester (D) which was amorphous, included THF-soluble components in an amount of 88% by weight, having a weight-average molecular weight of 6,000; chloroform-insoluble components in an amount of 0% by weight; an acid value of 35 mg KOH/g; and a glass transition temperature of 52° C.

Preparation for Toner

The procedure for preparation of the toner in Example 2 was repeated except for using the polyester (D) instead of the polyester (C) to prepare a toner (T3).

Example 4

Preparation for Prepolymer

A condensation reaction was performed among 795 parts of an adduct of bisphenol A with 2 moles of ethyleneoxide, 200 parts of isophthalic acid, 65 parts of terephthalic acid and 2 parts of dibutyltinoxide in a reaction vessel including a cooling pipe, a stirrer and a nitrogen inlet pipe at 210° C. for 8 hrs under a normal pressure and nitrogen stream to prepare a reaction product. Further, after the reaction product reacted while dehydrated under a depressure by 10 to 15 mm Hg for another 5 hrs, the reaction product was cooled to have a temperature of 80° C., and was further reacted with 150 parts of isophoronediisocyanate in ethylacetate for 2 hrs prepare a prepolymer (b). The prepolymer (b) had a weight-average molecular weight of 5,000 and an average number of functional groups of 2.00.

Preparation for Toner

The procedure for preparation of the toner in Example 2 was repeated except for using the prepolymer (b) instead of the prepolymer (a) and polyester (A) instead of the polyester (C) to prepare a toner (T4).

Example 5

Preparation for Toner

The procedure for preparation of the toner in Example 2 was repeated except for using 44 parts of the polyester (A) and 11 parts of the polyester (B) to prepare a toner (T5).

Example 6

Preparation for Toner

The procedure for preparation of the toner in Example 2 was repeated except for using 35 parts of the polyester (A) and 20 parts of the polyester (B) to prepare a toner (T6).

Example 7

A condensation reaction was performed among 520 parts of 1,4-butanediol, 610 parts of fumaric acid, 75 parts of trimellitic acid anhydride and 0.3 parts of hydroquinone in a reaction vessel including a cooling pipe, a stirrer and a nitrogen inlet pipe at 175° C. for 6 hrs under a normal pressure and nitrogen stream to prepare a reaction product. Further, after the reaction product reacted while dehydrated under a depressure by 5 to 10 mm Hg for another 1 hr, the reaction product was cooled to prepare a polyester (E). The polyester (E) which was crystalline, included THF-soluble components in an amount of 2% by weight; chloroform-insoluble components in an amount of 25% by weight; chloroform-soluble components having a weight-average molecular weight of 13,000; had an acid value of 9 mg KOH/g; and a glass transition temperature of 125° C.

Preparation for Toner

The procedure for preparation of the toner in Example 2 was repeated except for using 44 parts of the polyester (A) and 11 parts of the polyester (E) to prepare a toner (T7).

Example 8

A condensation reaction was performed among 520 parts of 1,4-butanediol, 628 parts of fumaric acid, 70 parts of trimellitic acid anhydride and 0.3 parts of hydroquinone in a reaction vessel including a cooling pipe, a stirrer and a nitrogen inlet pipe at 155° C. for 6 hrs under a normal pressure and nitrogen stream to prepare a reaction product. Further, after the reaction product reacted while dehydrated under a depressure by 5 to 10 mm Hg for another 1 hr, the reaction product was cooled to prepare a polyester (F). The polyester (F) which was crystalline, included THF-soluble components in an amount of 4% by weight; chloroform-insoluble components in an amount of 5% by weight; chloroform-soluble components having a weight-average molecular weight of 5,700; had an acid value of 30 mg KOH/g; and a glass transition temperature of 90° C.

Preparation for Toner

After 60 parts of the polyester (A), 20 parts of the polyester (B), 20 parts of the prepolymer (a), 2 parts of the ketimine compound (1), 5 parts of de-free fatty acid type carnauba wax, 10 parts of carbon black (#44 from Mitsubishi Chemical Corp.) and 1 part of azo compound including a metal were mixed with a HENSCHEL MIXER to prepare a mixture, the mixture was kneaded upon application of heat with a roll mill at 130 to 140° C. for about 30 min and cooled to have a room temperature to prepare a kneaded mixture. Then, the kneaded mixture was pulverized with a jet mill to prepare a pulverized mixture, and the pulverized mixture was classified with a wind classifier to prepare a mother toner having a volume-average particle diameter of 4.8 μm. 0.5 parts of hydrophobic silica were mixed with the mother toner to prepare a final toner (T8).

Example 9

Preparation for Prepolymer

A condensation reaction was performed among 795 parts of an adduct of bisphenol A with 2 moles of ethyleneoxide, 200 parts of isophthalic acid, 65 parts of terephthalic acid and 2 parts of dibutyltinoxide in a reaction vessel including a cooling pipe, a stirrer and a nitrogen inlet pipe at 210° C. for 8 hrs under a normal pressure and nitrogen stream to prepare a reaction product. Further, after the reaction product reacted while dehydrated under a depressure by 10 to 15 mm Hg for another 5 hrs, the reaction product was cooled to have a temperature of 80° C. and was further reacted with 175 parts of isophoronediisocyanate in ethylacetate for 3 hrs prepare a prepolymer (c). The prepolymer (c) had a weight-average molecular weight of 11,000 and an average number of functional groups of 2.25.

Preparation for Toner

The procedure for preparation of the toner in Example 2 was repeated except for using the prepolymer (c) instead of the prepolymer (a) and polyester (A) instead of the polyester (C) to prepare a toner (T9).

Properties of the polyester and prepolymer of the toners T1 to T9 are shown in Tables 1 and 2.

TABLE 1

| Resin | THF-soluble (%) | Chloroform-Soluble (%) | Mw of THF-soluble | Mw of Chloroform-Soluble | Mw of Prepolymer | Average number of functional groups of Prepolymer | Acid value | Tg |
|---|---|---|---|---|---|---|---|---|
| | | | Amorphous polyester | | | | | |
| Polyester (A) | 85 | 95 | 6,000 | — | — | — | 10 | 48 |
| Polyester (C) | 75 | 83 | 30,000 | — | — | — | 2 | 58 |

TABLE 1-continued

| Resin | THF-soluble (%) | Chloroform-Soluble (%) | Mw of THF-soluble | Mw of Chloroform-Soluble | Mw of Prepolymer | Average number of functional groups of Prepolymer | Acid value | Tg |
|---|---|---|---|---|---|---|---|---|
| Polyester (D) | 88 | 100 | 6,000 | — | — | — | 35 | 52 |
| | | | | Crystalline polyester | | | | |
| Polyester (B) | 5 | 100 | — | 5,500 | — | — | 8 | 85 |
| Polyester (E) | 2 | 75 | — | 13,000 | — | — | 9 | 125 |
| Polyester (F) | 4 | 95 | — | 5,700 | — | — | 30 | 90 |
| | | | | Prepolymer | | | | |
| Pre-polymer (a) | — | — | — | — | 5,000 | 2.25 | — | — |
| Pre-polymer (b) | — | — | — | — | 5,000 | 2.00 | — | — |
| Pre-polymer (c) | — | — | — | — | 11,000 | 2.25 | — | — |

Mw: weight-average molecular weight
Tg: Glass transition temperature

TABLE 2

| Toner | Amorphous polyester | Crystalline polyester | Prepolymer | Polyester THF-soluble (%) | Polyester chloroform-insoluble | Polyester Mw | Toner chloroform-Insoluble - content of colorant |
|---|---|---|---|---|---|---|---|
| T1 | A(95) | B(5) | a | 81 | 5 | 6,000 | 20 |
| T2 | C(95) | B(5) | a | 75 | 17 | 30,000 | 35 |
| T3 | D(95) | B(5) | a | 84 | 0 | 6,000 | 20 |
| T4 | A(95) | B(5) | b | 80 | 5 | 6,000 | 8 |
| T5 | A(80) | B(20) | a | 70 | 4 | 5,900 | 41 |
| T6 | A(64) | B(36) | a | 58 | 3 | 5,800 | 53 |
| T7 | A(80) | E(20) | a | 69 | 11 | 7,200 | 43 |
| T8 | A(80) | F(20) | a | 70 | 5 | 5,900 | 40 |
| T9 | A(95) | B(5) | c | 81 | 5 | 6,000 | 23 |

Mw: weight-average molecular weight
* The numbers in ( ) are % by weight in polyester resins Low-temperature fixability, high-temperature offset resistance, thermostable preservability and colorant dispersibility of the toners T1 to T9 were evaluated by the following methods.

Fixability

A copier MF2200 using a teflon roller ® as a fixing roller from Ricoh Company, Ltd., the fixer in which was modified was used to produce images on receiving papers TYPE 6200 from Ricoh Company, Ltd. Changing a fixing temperature thereof, a cold offset temperature (a minimum fixable temperature) and a hot offset temperature (a hot offset resistance temperature) were determined. Conventional low-temperature fixable toners have minimum fixable temperatures of from about 140 to 150° C. The cold offset temperature was determined under image forming conditions of a paper feeding linear speed of 120 to 150 mm/sec, a surface pressure of 1.2 Kgf/cm$^2$ and a nip width of 3 mm. The hot offset temperature was determined under image forming conditions of a paper feeding linear speed of 50 mm/sec, a surface pressure of 2.0 Kgf/cm$^2$ and a nip width of 4.5 mm. The evaluation standards of each property were as follows.

<Low-temperature Fixability (5 Grades)> better
◎: less than 130° C.
○: 130 to 139° C.
□: 140 to 149° C.
Δ: 150 to 159° C.
X: not less than 160° C.
worse <Hot offset resistance (5 grades)> better
◎: not less than 201° C.
○: 200 to 191° C.
□: 190 to 181° C.
Δ: 180 to 171° C.
X: not less than 170° C.
worse Thermostable Preservability 20 g of a toner were placed in a glass bottle having a capacity of 20 ml, and the glass bottle was tapped for about 50 times to densely coagulate the toner. Then, the glass bottle including the toner was left in a high-temperature tank having a temperature of 50° C. for 24 hrs to measure a penetration of the toner with a penetrometer.

better

◎: penetrated

○: to 26 mm

□: 25 to 21 mm

Δ: 20 to 16 mm

X: not greater than 15 mm worse

Colorant Dispersibility

Colorant dispersibility in a toner was visually observed with a transmission optical microscope at 1000-fold magnification.

better

◎: the colorant was uniformly dispersed in a toner in a form of primary particles ○: 3 secondary agglomerates or less of the colorant were observed, but the colorant was uniformly dispersed □: a secondary agglomerate was not observed, but the colorant was nonuniformly dispersed Δ: 3 secondary agglomerates or more of the colorant were observed, and the colorant was nonuniformly dispersed X: innumerable secondary agglomerates of the colorant were observed, and apparently, the colorant was nonuniformly dispersed worse The evaluation results are shown in Table 3.

TABLE 3

| Toner | Acid value | Tg | Dv | Dv/Dn | Average circularity | BET | Low-temperature fixability | Offset resistance | Preservability | Colorant dispersibility |
|---|---|---|---|---|---|---|---|---|---|---|
| Ex. 1 (T1) | 9.5 | 47.2 | 6.8 | 1.13 | 0.96 | 15 | ○ (132° C.) | ○ (195° C.) | ○ (15 mm) | ○ |
| Ex. 2 (T2) | 1.7 | 54.0 | 5.9 | 1.20 | 0.98 | 1.9 | ○ (137° C.) | □ (185° C.) | ◎ | ◎ |
| Ex. 3 (T3) | 31.3 | 51.2 | 4.5 | 1.23 | 0.95 | 3.1 | ◎ (115° C.) | ◎ (205° C.) | ◎ | ◎ |
| Ex. 4 (T4) | 8.0 | 47.3 | 7.3 | 1.08 | 0.96 | 2.5 | ◎ (115° C.) | □ (185° C.) | ○ (15 mm) | ◎ |
| Ex. 5 (T5) | 7.0 | 53.1 | 5.0 | 1.15 | 0.94 | 5.4 | ○ (132° C.) | ◎ (210° C.) | ◎ | ○ |
| Ex. 6 (T6) | 6.8 | 59.0 | 5.1 | 1.13 | 0.98 | 2.8 | □ (140° C.) | ◎ (220° C.) | ◎ | □ |
| Ex. 7 (T7) | 7.5 | 62.8 | 3.9 | 1.05 | 0.99 | 2.7 | ○ (135° C.) | ◎ (210° C.) | ◎ | ○ |
| Ex. 8 (T8) | 12.6 | 55.0 | 4.8 | 1.16 | 0.96 | 4.5 | ○ (135° C.) | ○ (200° C.) | ◎ | ○ |
| Ex. 9 (T9) | 8.9 | 46.9 | 5.3 | 1.10 | 0.96 | 3.6 | ◎ (115° C.) | ◎ (205° C.) | ○ (18 mm) | ○ |

Comparative Example 1

Preparation for Polyester

A condensation reaction was performed among 690 parts of an adduct of bisphenol A with 2 moles of ethyleneoxide, 270 parts of terephthalic acid and 12.0 parts of trimellitic acid anhydride in a reaction vessel including a cooling pipe, a stirrer and a nitrogen inlet pipe at 210° C. for 10 hrs under a normal pressure and nitrogen stream to prepare a reaction product. Further, after the reaction product reacted while dehydrated under a depressure by 10 to 15 mm Hg for another 7 hrs, the reaction product was cooled to prepare a polyester (G). The polyester (G) which was amorphous, included THF-soluble components in an amount of 72% by weight, having a weight-average molecular weight of 38,000; chloroform-insoluble components in an amount of 25% by weight; had an acid value of 11 mg KOH/g; and a glass transition temperature of 53° C.

Preparation for Toner

The procedure for preparation of the toner in Example 2 was repeated except for using 34 parts of the polyester (G) and 21 parts of the polyester (B) to prepare a toner (T10).

Comparative Example 2

Preparation for Polyester

A condensation reaction was performed among 690 parts of an adduct of bisphenol A with 2 moles of ethyleneoxide, 270 parts of terephthalic acid and 10.5 parts of trimellitic acid anhydride in a reaction vessel including a cooling pipe, a stirrer and a nitrogen inlet pipe at 210° C. for 10 hrs under a normal pressure and nitrogen stream to prepare a reaction product. Further, after the reaction product reacted while dehydrated under a depressure by 10 to 15 mm Hg for another 7 hrs, the reaction product was cooled to prepare a polyester (H). The polyester (H) which was amorphous, included THF-soluble components in an amount of 72% by weight, having a weight-average molecular weight of 43,000; chloroform-insoluble components in an amount of 27% by weight; had an acid value of 5 mg KOH/g; and a glass transition temperature of 56° C.

A condensation reaction was performed among 520 parts of 1,4-butanediol, 510 parts of fumaric acid, 58 parts of trimellitic acid anhydride and 0.3 parts of hydroquinone in a reaction vessel including a cooling pipe, a stirrer and a nitrogen inlet pipe at 175° C. for 6 hrs under a normal pressure and nitrogen stream to prepare a reaction product. Further, after the reaction product reacted while dehydrated under a depressure by 5 to 10 mm Hg for another 2 hrs, the reaction product was cooled to prepare a polyester (I). The polyester (I) which was crystalline, included THF-soluble components in an amount of 23% by weight; chloroform-insoluble components in an amount of 35% by weight; chloroform-soluble components having a weight-average molecular weight of 15,000; had an acid value of 6 mg KOH/g; and a glass transition temperature of 127° C.

Preparation for Toner

The procedure for preparation of the toner in Example 2 was repeated except for using 34 parts of the polyester (H) and 21 parts of the polyester (I) to prepare a toner (T11).

Comparative Example 3

Preparation for Prepolymer

A condensation reaction was performed among 640 parts of an adduct of bisphenol A with 2 moles of ethyleneoxide, 50 parts of pentaerythritol, 200 parts of isophthalic acid, 65 parts of terephthalic acid and 2 parts of dibutyltinoxide in a reaction vessel including a cooling pipe, a stirrer and a nitrogen inlet pipe at 210° C. for 8 hrs under a normal pressure and nitrogen stream to prepare a reaction product. Further, after the reaction product reacted while dehydrated under a depressure by 10 to 15 mm Hg for another 6 hrs, the reaction product was cooled to have a temperature of 80° C. and was further reacted with 195 parts of isophoronediisocyanate in ethylacetate for 3 hrs prepare a prepolymer (d). The prepolymer (d) had a weight-average molecular weight of 13,000 and an average number of functional groups of 2.60.

Preparation for Toner

After 80 parts of the polyester (A), 20 parts of the prepolymer (d), 2 parts of the ketimine compound (1), 5 parts of de-free fatty acid type camauba wax, 10 parts of carbon black (#44 from Mitsubishi Chemical Corp.) and 1 part of azo compound including a metal were mixed with a HENSCHEL MIXER to prepare a mixture, the mixture was kneaded upon application of heat with a roll mill at 130 to 140° C. for about 30 min and cooled to have a room temperature to prepare a kneaded mixture. Then, the kneaded mixture was pulverized with a jet mill to prepare a pulverized mixture, and the pulverized mixture was classified with a wind classifier to prepare a mother toner having a volume-average particle diameter of 5.3 μm. 0.5 parts of hydrophobic silica were mixed with the mother toner to prepare a final toner (T12).

Comparative Example 4

Preparation for Toner

The procedure for preparation of the toner in Example 2 was repeated except for using the polyester (G) instead of the polyester (C) to prepare a toner (T13).

Comparative Example 5

Preparation for Toner

The procedure for preparation of the toner in Example 2 was repeated except for using 31 parts of the polyester (A) and 24 parts of the polyester (B) to prepare a toner (T14).

Comparative Example 6

Preparation for Polyester

A condensation reaction was performed among 690 parts of an adduct of bisphenol A with 2 moles of ethyleneoxide, 255 parts of terephthalic acid and 13.5 parts of trimellitic acid anhydride in a reaction vessel including a cooling pipe, a stirrer and a nitrogen inlet pipe at 210° C. for 10 hrs under a normal pressure and nitrogen stream to prepare a reaction product. Further, after the reaction product reacted while dehydrated under a depressure by 10 to 15 mm Hg for another 8 hrs, the reaction product was cooled to prepare a polyester (J). The polyester (J) which was amorphous, included THF-soluble components in an amount of 65% by weight, having a weight-average molecular weight of 46,000; chloroform-insoluble components in an amount of 30% by weight; had an acid value of 7 mg KOH/g; and a glass transition temperature of 59° C.

A condensation reaction was performed among 520 parts of 1,4-butanediol, 610 parts of fumaric acid, 78 parts of trimellitic acid anhydride and 0.2 parts of hydroquinone in a reaction vessel including a cooling pipe, a stirrer and a nitrogen inlet pipe at 175° C. for 6 hrs under a normal pressure and nitrogen stream to prepare a reaction product. Further, after the reaction product reacted while dehydrated under a depressure by 5 to 10 mm Hg for another 2 hrs, the reaction product was cooled to prepare a polyester (K). The polyester (K) which was crystalline, included THF-soluble components in an amount of 33% by weight; chloroform-insoluble components in an amount of 0% by weight; chloroform-soluble components having a eight-average molecular weight of 1,800; had an acid value of 15 mg KOH/g; and a glass transition temperature of 52° C.

Preparation for Toner

The procedure for preparation of the toner in Example 2 was repeated except for using 34 parts of the polyester (H) and 21 parts of the polyester (I) to prepare a toner (T11).

Comparative Example 7

Preparation for Polyester

A condensation reaction was performed among 600 parts of an adduct of bisphenol A with 2 moles of ethyleneoxide, 30 parts of diethylene glycol, 260 parts of terephthalic acid and 22 parts of trimellitic acid anhydride in a reaction vessel including a cooling pipe, a stirrer and a nitrogen inlet pipe at 210° C. for 10 hrs under a normal pressure and nitrogen stream to prepare a reaction product. Further, after the reaction product reacted while dehydrated under a depressure by 10 to 15 mm Hg for another 8 hrs, the reaction product was cooled to prepare a polyester (L). The polyester (L) which was amorphous, included THF-soluble components in an amount of 85% by weight, having a weight-average molecular weight of 51,000; chloroform-insoluble components in an amount of 5% by weight; had an acid value of 4 mg KOH/g; and a glass transition temperature of 60° C.

Preparation for Toner

The procedure for preparation of the toner in Example 2 was repeated except for using 34 parts of the polyester (L) and 21 parts of the polyester (K) to prepare a toner (T16).

Comparative Example 8

Preparation for Polyester

A condensation reaction was performed among 670 parts of an adduct of bisphenol A with 2 moles of ethyleneoxide and 3000 parts of terephthalic acid in a reaction vessel including a cooling pipe, a stirrer and a nitrogen inlet pipe at 230° C. for 12 hrs under a normal pressure and nitrogen stream to prepare a reaction product. Further, after the reaction product reacted while dehydrated under a depressure by 10 to 15 mm Hg for another 1 hr, the reaction product was cooled to prepare a polyester (M). The polyester (M) which was amorphous, included THF-soluble components in an amount of 84% by weight, having a weight-average molecular weight of 10,000; chloroform-insoluble components in an amount of 2% by weight; had an acid value of 51 mg KOH/g; and a glass transition temperature of 61° C.

Preparation for Toner

The procedure for preparation of the toner in Example 2 was repeated except for using the polyester (M) instead of the polyester (C) to prepare a toner (T17).

Comparative Example 9

Preparation for Polyester

A condensation reaction was performed among 670 parts of an adduct of bisphenol A with 2 moles of ethyleneoxide and 3000 parts of terephthalic acid in a reaction vessel including a cooling pipe, a stirrer and a nitrogen inlet pipe at 23020 C. for 12 hrs under a normal pressure and nitrogen stream to prepare a reaction product. Further, after the reaction product reacted while dehydrated under a depressure by 10 to 15 mm Hg for another 2 hrs, the reaction product was cooled to prepare a polyester (N). The polyester (N) which was amorphous, included THF-soluble components in an amount of 87% by weight, having a weight-average molecular weight of 13,000; chloroform-insoluble components in an amount of 8% by weight; had an acid value of 38 mg KOH/g; and a glass transition temperature of 69° C.

Preparation for Toner

The procedure for preparation of the toner in Example 2 was repeated except for using the polyester (N) instead of the polyester (C) to prepare a toner (T18).

Comparative Example 10

Preparation for Polyester

A condensation reaction was performed among 520 parts of 1,4-butanediol, 585 parts of fumaric acid, 87 parts of trimellitic acid anhydride and 0.2 parts of hydroquinone in a reaction vessel including a cooling pipe, a stirrer and a nitrogen inlet pipe at 175° C. for 6 hrs under a normal pressure and nitrogen stream to prepare a reaction product. Further, after the reaction product reacted while dehydrated under a depressure by 5 to 10 mm Hg for another 2 hrs, the reaction product was cooled to prepare a polyester (O). The polyester (O) which was crystalline, included THF-soluble components in an amount of 12% by weight; chloroform-insoluble components in an amount of 45% by weight; chloroform-soluble components having a eight-average molecular weight of 20,000; had an acid value of 25 mg KOH/g; and a glass transition temperature of 100° C.

Preparation for Toner

The procedure for preparation of the toner in Example 2 was repeated except for using 52 parts of the polyester (A) and 3 parts of the polyester (O) to prepare a toner (T19).

Comparative Example 11

Preparation for Polyester

A condensation reaction was performed among 435 parts of 1,4-butanediol, 65 parts of ethyleneglycol, 570 parts of fumaric acid, 50 parts of trimellitic acid anhydride and 0.3 parts of hydroquinone in a reaction vessel including a cooling pipe, a stirrer and a nitrogen inlet pipe at 175° C. for 6 hrs under a normal pressure and nitrogen stream to prepare a reaction product. Further, after the reaction product reacted while dehydrated under a depressure by 5 to 10 mm Hg for another 2 hrs, the reaction product was cooled to prepare a polyester (P). The polyester (P) which was crystalline, included THF-soluble components in an amount of 15% by weight; chloroform-insoluble components in an amount of 25% by weight; chloroform-soluble components having a eight-average molecular weight of 28,000; had an acid value of 20 mg KOH/g; and a glass transition temperature of 120° C.

Preparation for Toner

The procedure for preparation of the toner in Example 2 was repeated except for using 52 parts of the polyester (A) and 3 parts of the polyester (P) to prepare a toner (T20).

Comparative Example 12

Preparation for Polyester

A condensation reaction was performed among 520 parts of 1,4-butanediol, 650 parts of fumaric acid, 70 parts of trimellitic acid anhydride and 0.3 parts of hydroquinone in a reaction vessel including a cooling pipe, a stirrer and a nitrogen inlet pipe at 155° C. for 6 hrs under a normal pressure and nitrogen stream to prepare a reaction product. Further, after the reaction product reacted while dehydrated under a depressure by 5 to 10 mm Hg for another 1 hr, the reaction product was cooled to prepare a polyester (Q). The polyester (Q) which was crystalline, included THF-soluble components in an amount of 8% by weight; chloroform-insoluble components in an amount of 20% by weight; chloroform-soluble components having a eight-average molecular weight of 7,000; had an acid value of 55 mg KOH/g; and a glass transition temperature of 95° C.

Preparation for Toner

The procedure for preparation of the toner in Example 2 was repeated except for using 52 parts of the polyester (A) and 3 parts of the polyester (Q) to prepare a toner (T21).

Comparative Example 13

Preparation for Polyester

A condensation reaction was performed among 435 parts of 1,4-butanediol, 65 parts of ethyleneglycol, 610 parts of fumaric acid, 50 parts of trimellitic acid anhydride and 0.3 parts of hydroquinone in a reaction vessel including a cooling pipe, a stirrer and a nitrogen inlet pipe at 175° C. for 6 hrs under a normal pressure and nitrogen stream to prepare a reaction product. Further, after the reaction product reacted while dehydrated under a depressure by 5 to 10 mm Hg for another 2 hrs, the reaction product was cooled to prepare a polyester (R). The polyester (R) which was crystalline, included THF-soluble components in an amount of 5% by weight; chloroform-insoluble components in an amount of 25% by weight; chloroform-soluble components having a eight-average molecular weight of 24,000; had an acid value of 40 mg KOH/g; and a glass transition temperature of 140° C.

Preparation for Toner

The procedure for preparation of the toner in Example 2 was repeated except for using 52 parts of the polyester (A) and 3 parts of the polyester (R) to prepare a toner (T20).

Comparative Example 14

Preparation for Prepolymer

A condensation reaction was performed among 795 parts of an adduct of bisphenol A with 2 moles of ethyleneoxide, 210 parts of isophthalic acid, 75 parts of terephthalic acid and 2 parts of dibutyltinoxide in a reaction vessel including a cooling pipe, a stirrer and a nitrogen inlet pipe at 210° C. for 8 hrs under a normal pressure and nitrogen stream to prepare a reaction product. Further, after the reaction product reacted while dehydrated under a depressure by 10 to 15 mm Hg for another 5 hrs, the reaction product was cooled to have a temperature of 80° C., and was further reacted with 180 parts of isophoronediisocyanate in ethylacetate for 3 hrs prepare a prepolymer (e). The prepolymer (e) had a weight-average molecular weight of 22,000 and an average number of functional groups of 2.25.

Preparation for Toner

The procedure for preparation of the toner in Example 2 was repeated except for using the prepolymer (e) instead of the prepolymer (a) and polyester (A) instead of the polyester (C) to prepare a toner (T23).

Comparative Example 15

Preparation for Prepolymer

A condensation reaction was performed among 795 parts of an adduct of bisphenol A with 2 moles of ethyleneoxide, 200 parts of isophthalic acid, 65 parts of terephthalic acid and 2 parts of dibutyltinoxide in a reaction vessel including a cooling pipe, a stirrer and a nitrogen inlet pipe at 210° C. for 8 hrs under a normal pressure and nitrogen stream to prepare a reaction product. Further, after the reaction product reacted while dehydrated under a depressure by 10 to 15 mm Hg for another 5 hrs, the reaction product was cooled to have a temperature of 80° C. and was further reacted with 150 parts of isophoronediisocyanate in ethylacetate for 2 hrs prepare a prepolymer (f). The prepolymer (f) had a weight-average molecular weight of 5,000 and an average number of functional groups of 1.75.

Preparation for Toner

The procedure for preparation of the toner in Example 2 was repeated except for using the prepolymer (f) instead of the 5 prepolymer (a) and polyester (A) instead of the polyester (C) to prepare a toner (T24).

Properties of the polyester and prepolymer of the toners T10 to T24 are shown in tables 4 and 5.

TABLE 4

| Resin | THF-soluble (%) | Chloroform-Soluble (%) | Mw of THF-soluble | Mw of Chloroform-Soluble | Mw of Prepolymer | Average number of functional groups of Prepolymer | Acid value | Tg |
|---|---|---|---|---|---|---|---|---|
| Polyester (G) | 72 | 75 | 38,000 | — | — | — | 11 | 53 |
| Polyester (H) | 72 | 73 | 43,000 | — | — | — | 5 | 56 |
| Polyester (I) | 23 | 65 | — | 15,000 | — | — | 6 | 127 |
| Polyester (J) | 65 | 70 | 46,000 | — | — | — | 7 | 59 |
| Polyester (K) | 33 | 100 | — | 18,000 | — | — | 15 | 52 |
| Polyester (L) | 85 | 95 | 51,000 | — | — | — | 4 | 60 |
| Polyester (M) | 84 | 98 | 10,000 | — | — | — | 51 | 61 |
| Polyester (N) | 87 | 92 | 13,000 | — | — | — | 38 | 69 |
| Polyester (O) | 12 | 55 | — | 20,000 | — | — | 25 | 100 |
| Polyester (P) | 15 | 75 | — | 28,000 | — | — | 20 | 120 |
| Polyester (Q) | 8 | 80 | — | 7,000 | — | — | 55 | 95 |
| Polyester (R) | 5 | 75 | — | 24,000 | — | — | 40 | 140 |
| Pre-polymer (d) | — | — | — | — | 13,000 | 2.60 | — | — |
| Pre-polymer (e) | — | — | — | — | 22,000 | 2.25 | — | — |

TABLE 4-continued

| Resin | THF-soluble (%) | Chloroform-Soluble (%) | Mw of THF-soluble | Mw of Chloroform-Soluble | Mw of Prepolymer | Average number of functional groups of Prepolymer | Acid value | Tg |
|---|---|---|---|---|---|---|---|---|
| Pre-polymer (f) | — | — | — | — | 5,000 | 1.75 | — | — |

Mw: weight-average molecular weight
Tg: Glass transition temperature

TABLE 5

| Toner | Amorphous polyester | Crystalline polyester | Prepolymer | Polyester THF-soluble (%) | Polyester chloroform-insoluble | Polyester Mw | Toner chloroform-Insoluble - content of colorant |
|---|---|---|---|---|---|---|---|
| T10 | G(62) | E(38) | a | 45 | 25 | 27,000 | 45 |
| T11 | H(62) | I(38) | a | 55 | 31 | 29,000 | 48 |
| T12 | A(100) | — | d | 85 | 5 | 6,000 | 65 |
| T13 | G(95) | B(5) | a | 69 | 24 | 35,000 | 8 |
| T14 | A(57) | B(43) | a | 51 | 3 | 5,700 | 15 |
| T15 | J(62) | K(38) | a | 53 | 18 | 28,000 | 38 |
| T16 | L(62) | K(38) | a | 65 | 3 | 29,000 | 30 |
| T17 | M(80) | B(5) | a | 80 | 2 | 10,000 | 15 |
| T18 | N(95) | B(5) | a | 83 | 8 | 13,000 | 15 |
| T19 | A(95) | O(5) | a | 81 | 7 | 7,100 | 12 |
| T20 | A(95) | P(5) | a | 82 | 6 | 7,200 | 13 |
| T21 | A(95) | Q(5) | a | 80 | 6 | 6,100 | 12 |
| T22 | A(95) | R(5) | a | 81 | 6 | 6,900 | 13 |
| T23 | A(95) | B(5) | e | 81 | 5 | 6,000 | 28 |
| T24 | A(95) | B(5) | f | 81 | 5 | 6,000 | 4 |

Mw: weight-average molecular weight
* The numbers in ( ) are % by weight in polyester resins The procedure for evaluation of the toner T1 was repeated to evaluate low-temperature fixability, high-temperature offset resistance, thermostable preservability and colorant dispersibility of the toners T10 to T24. The evaluation results are shown in Table 6.

TABLE 6

| Toner | Acid value | Tg | Dv | Dv/Dn | Average circularity | BET | Low-temperature fixability | Offset resistance | Preservability | Colorant dispersibility |
|---|---|---|---|---|---|---|---|---|---|---|
| Com. Ex. 1 (T10) | 10.5 | 51.2 | 5.0 | 1.12 | 0.98 | 2.7 | Δ (155° C.) | □ (185° C.) | ◎ | x |
| Com. Ex. 2 (T11) | 5.1 | 73.5 | 4.8 | 1.15 | 0.98 | 2.3 | x (170° C.) | □ (185° C.) | ◎ | □ |
| Com. Ex. 3 (T12) | 9.2 | 47.8 | 5.3 | 1.08 | 0.97 | 3.0 | x (165° C.) | ◎ (220° C.) | ○ (15 mm) | ◎ |
| Com. Ex. 4 (T13) | 10.8 | 53.0 | 5.0 | 1.15 | 0.97 | 1.9 | x (175° C.) | Δ (180° C.) | ◎ | ◎ |
| Com. Ex. 5 (T14) | 8.5 | 62.1 | 8.3 | 1.20 | 0.96 | 3.5 | □ (145° C.) | ○ (195° C.) | ◎ | Δ |
| Com. Ex. 6 (T15) | 8.5 | 54.5 | 3.9 | 1.18 | 0.95 | 5.0 | □ (145° C.) | □ (190° C.) | ◎ | □ |
| Com. Ex. 7 (T16) | 5.8 | 55.3 | 6.8 | 1.10 | 0.99 | 2.5 | □ (140° C.) | □ (185° C.) | ◎ | □ |

TABLE 6-continued

| Toner | Acid value | Tg | Dv | Dv/Dn | Average circularity | BET | Low-temperature fixability | Offset resistance | Preservability | Colorant dispersibility |
|---|---|---|---|---|---|---|---|---|---|---|
| Com. Ex. 8 (T17) | 45.2 | 60.5 | 7.5 | 1.08 | 0.97 | 1.5 | ◎ (125° C.) | □ (185° C.) | ◎ | ◎ |
| Com. Ex. 9 (T18) | 37.0 | 67.2 | 5.0 | 1.19 | 0.97 | 4.3 | □ (145° C.) | ○ (195° C.) | ◎ | ◎ |
| Com. Ex. 10 (T19) | 10.6 | 52.0 | 4.3 | 1.28 | 0.94 | 5.3 | □ (140° C.) | □ (185° C.) | □ (23 mm) | □ |
| Com. Ex. 11 (T20) | 10.1 | 53.8 | 5.2 | 1.22 | 0.92 | 6.3 | □ (140° C.) | ○ (195° C.) | ◎ | □ |
| Com. Ex. 12 (T21) | 12.0 | 51.8 | 4.8 | 1.16 | 0.96 | 2.5 | ◎ (120° C.) | □ (185° C.) | ◎ | ◎ |
| Com. Ex. 13 (T22) | 11.3 | 54.2 | 6.7 | 1.19 | 0.97 | 3.2 | □ (145° C.) | ○ (195° C.) | ◎ | ◎ |
| Com. Ex. 14 (T23) | 9.7 | 46.9 | 5.5 | 1.10 | 0.97 | 1.9 | ◎ (120° C.) | □ (185° C.) | □ (22 mm) | ◎ |
| Com. Ex. 15 (T24) | 9.7 | 49.0 | 2.9 | 1.18 | 0.94 | 5.7 | ◎ (115° C.) | x (160° C.) | □ (23 mm) | □ |

This document claims priority and contains subject matter related to Japanese Patent Application No. 2003-179554 filed on Jun. 24, 2003, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

a binder;

a colorant; and a wax, wherein:

the binder comprises:

a reaction product of a polymer having a group capable of reacting with an active hydrogen with a compound having an active hydrogen; and a polyester resin comprising:

tetrahydrofuran(THF)-soluble resin components in an amount of from 50 to 85% by weight; and chloroform-insoluble components in an amount of from 0 to 30% by weight;

the toner satisfies the following relationship (1):

$$5\% \text{ by weight} < (C1-C2) < 60\% \text{ by weight} \quad (1)$$

wherein C1 represents a content of chloroform-insoluble components in the toner in units of % by weight and C2 represents a content of the colorant therein in units of % by weight; and the toner has a specific surface area of from 1.0 to 6.0 $m^2/g$ when measured by a BET method.

2. The toner of claim 1, wherein the polyester resin THF-soluble components have a weight-average molecular weight of from 1,000 to 30,000.

3. The toner of claim 1, wherein the toner has an acid value of from 0.5 to 40.0 mg KOH/g.

4. The toner of claim 1, wherein the toner has a glass transition temperature of from 40 to 70° C.

5. The toner of claim 1, wherein the toner has a volume-average particle diameter of from 3 to 8 μm.

6. The toner of claim 1, wherein the toner satisfies the following relationship:

$$Dv/Dn \leqq 1.25$$

wherein the Dv represents a volume-average particle diameter of the toner and Dn represent a number-average particle diameter thereof.

7. The toner of claim 1, wherein the toner has an average circularity of from 0.94 to 1.00.

8. A method of preparing the toner according to claim 1, comprising:

dissolving or dispersing the polyester resin, the polymer having a group capable of reacting with an active hydrogen, the colorant and the wax in an organic solvent to prepare a first solution or dispersion;

dispersing the first solution or dispersion in an aqueous medium to prepare a second solution;

reacting the polymer with the compound having an active hydrogen; and removing the organic solvent from the second solution while or after the reacting is performed to prepare particles; and washing and drying the particles.

9. The method of claim 8, wherein the polymer has a weight-average molecular weight of from 3,000 to 20,000.

10. The method of claim 8, wherein the polymer includes not less than two functional groups.

* * * * *

UNITED STATES PATENT AND TRADEMARK OFFICE

CERTIFICATE OF CORRECTION

PATENT NO. : 7,374,848 B2
APPLICATION NO. : 10/872640
DATED : May 20, 2008
INVENTOR(S) : Matsuoka et al.

It is certified that error appears in the above-identified patent and that said Letters Patent is hereby corrected as shown below:

On the title page, Item (54), and Column 1 lines 1-2, the title is incorrect. Item (54) and Column 1, lines 1-2, should read:

-- (54) TONER AND METHOD OF PREPARING THE TONER --

Signed and Sealed this

Twenty-ninth Day of July, 2008

JON W. DUDAS
*Director of the United States Patent and Trademark Office*